US008152699B1

(12) United States Patent
Ma et al.

(10) Patent No.: US 8,152,699 B1
(45) Date of Patent: Apr. 10, 2012

(54) APPARATUS AND METHOD FOR REDUCED-GRAVITY SIMULATION

(75) Inventors: Ou Ma, Las Cruces, NM (US); Jiegao Wang, Wuhu (CN)

(73) Assignee: Arrowhead Center, Inc., Las Cruces, NM (US)

( * ) Notice: Subject to any disclaimer, the term of this patent is extended or adjusted under 35 U.S.C. 154(b) by 58 days.

(21) Appl. No.: 12/487,579

(22) Filed: Jun. 18, 2009

Related U.S. Application Data

(60) Provisional application No. 61/074,107, filed on Jun. 19, 2008.

(51) Int. Cl.
*A63B 22/00* (2006.01)
*A63B 22/02* (2006.01)

(52) U.S. Cl. ..... 482/69; 482/54

(58) Field of Classification Search ..... 482/54, 482/66–69, 143, 144; 601/5; 473/131; 434/255
See application file for complete search history.

(56) References Cited

U.S. PATENT DOCUMENTS 2,812,010 A * 11/1957 Abdallah ..... 482/69
3,330,052 A 7/1967 Johnson et al.
3,449,843 A 6/1969 Richter et al.
3,516,179 A 6/1970 Dane
3,550,585 A 12/1970 Wayne et al.
3,583,322 A 6/1971 Vykukal
3,701,528 A 10/1972 Ryan
4,620,829 A 11/1986 Herve
4,779,712 A 10/1988 Peterczak et al.
5,667,461 A * 9/1997 Hall ..... 482/69
6,886,471 B2 5/2005 Rodnunsky
7,780,573 B1 * 8/2010 Carmein ..... 482/4
2003/0153438 A1 8/2003 Gordon et al.
2004/0063550 A1 4/2004 Harris
2005/0101448 A1 * 5/2005 He et al. ..... 482/54
2006/0241539 A1 * 10/2006 Agrawal et al. ..... 602/23
2006/0260621 A1 * 11/2006 Agrawal et al. ..... 128/845
2007/0123997 A1 5/2007 Herr et al.
2008/0054836 A1 3/2008 Rodnunsky et al.

(Continued)

FOREIGN PATENT DOCUMENTS

SU 450090 11/1974

(Continued)

OTHER PUBLICATIONS

"NASA microgravity flight history", http://jsc_aircraftops.jsc.nasa.gov/Reduced_Gravity/C_9B_history.html Mar. 25, 2008.

(Continued)

*Primary Examiner* — Allana Lewin
(74) *Attorney, Agent, or Firm* — Deborah A. Peacock; Samantha A. Updegraff; Peacock Myers, P.C.

(57) ABSTRACT

The present invention comprises an apparatus and method for gravity-balanced apparatuses for training humans for space exploration and other applications. The embodiment of the simulation apparatus is less expensive to build and safe to operate and adaptable to numerous applications, including but not limited to theme parks, museums, training facilities, educational/research labs, and others, for people to experience walking and other perambulations in lower or zero gravity environments. The present invention is statically-balanced and comprises a spring apparatus that is easily adjusted. An embodiment of the present invention provides an apparatus and method for simulating walking in a zero-gravity or reduced-gravity environment.

19 Claims, 13 Drawing Sheets

U.S. PATENT DOCUMENTS

2009/0215588 A1* 8/2009 Riener et al. ..... 482/7

FOREIGN PATENT DOCUMENTS

SU 1759731 9/1992

OTHER PUBLICATIONS

Agrawal, Abhishek et al., "Effect of Gravity Balancing on Biped Stability", *Proceedings of the 2004 IEEE International Conference on Robotics & Automation* New Orleans 2004 , 4228-4233.

Bagci, Cemil , "Shaking Force Balancing of Planar Linkages with Force Transmission Irregularities Using Balancing Idler Loops", *Mechanism and Machine Theory* vol. 14, Pergamon Press Ltd., Great Britain 1979 , 267-284.

Banala, Sai K. et al., "Gravity-Balancing Leg Orthosis and Its Performance Evaluation", *IEEE Transactions on Robotics* vol. 22, No. 6 Dec. 2006 , 1228-1239.

Cardoso, Luis F. et al., "Conceptual Design of a Passive Arm Orthosis", *Proceedings of DETC '02 ASME 2002 Design Engineering Technical Conferences and Computer and Informtaion in Engineering Conference* Montreal, Canada Sep. 29-Oct. 2, 2002 , 747-756.

Ebert-Uphoff, Imme et al., "Static Balancing of Spatial Parallel Platform Mechanisms-Revisited", *Journal of Mechanical Design* vol. 122, ASME Mar. 2000 , 43-51.

Fattah, Abbas et al., "On the Design of a Passive Orthosis to Gravity Balance Human Legs", *Transactions of the ASME* vol. 127, ASME Jul. 2005 , 802-808.

Feng, Gao , "Complete Shaking Force and Shaking Moment Balancing of 17 Types of Eight-Bar Linkages Only with Revolute Pairs", *Mech. Mach. Theory* vol. 26, No. 2, Pergamon Press 1991 , 197-206.

Fujii, Hironori A. et al., "Ground-Based Simulation of Space Manipulators Using Test Bed with Suspension System", *Journal of Guidance, Control, and Dynamics* vol. 19, No. 5 Sep.-Oct. 1996 , 985-991.

Gosselin, Clement M. et al., "Static Balancing of Spatial Six-Degree-of-Freedom Parallel Mechanisms with Revolute Actuators", *Journal of Robotic Systems* vol. 17, No. 3, John Wiley & Sons, Inc. 2000 , 159-170.

Griffin, B. N. , "Zero-G Simulation Verifies EVA Servicing of Space Station Modules", *AIAA Space Station in the Twenty-First Century* AIM-86/2312, Reno Nevada Sep. 3, 1986 , 2-5.

Herder, Just L. , "Development of a Statically Balanced Arm Support: ARMON", *Proceedings of the 2005 IEEE 9th International Conference on Rehabilitation Robotics* Chicago, IL. Jun. 28, 2005 , 281-286.

Homan, David J. et al., "An Integrated EVA/RMS Virtual Reality Simulation, Including Force Feedback, for Astronaut Training", *Proceedings of the AIAA Flight Simulation Technologies Conference*, San Diego, CA. Technical Papers (A96-35001 09-01), Reston, VA. 1996 , 216-223.

Kazerooni, H. et al., "A New Architecture for Direct Drive Robots", *Proc. of the IEEE Int. Conference on Robotics and Automation* Philadelphia 1988 , 442-445.

Lowen, G. G. et al., "Balancing of Linkages—An Update", *Mechanism and Machine Theory* vol. 18, No. 3, Pergamon Press Ltd., Great Britain 1983 , 213-220.

Ma, Ou et al., "Dynamically Removing Partial Body Mass Using Acceleration Feedback for Neural Training", *Proceedings of the 2007 IEEE 10th International Conference on Rehabilitation Robotics* Noordwijk, The Netherlands Jun. 12, 2007 , 1102-1107.

Nathan, R. H. , "A Constant Force Generation Mechanism", *Transactions of the ASME* vol. 107, ASME Dec. 1985 , 508-512.

Schwartz, Jana L. et al., "Historical Review of Air-Bearing Spacecraft Simulators", *Journal of Guidance, Control, and Dynamics* vol. 26, No. 4 Jul.-Aug. 2003 , 513-522.

Smith, M. R. "Optimal Balancing of Planar Multi-Bar Linkages", *Proceedings of the 5th World Congress on the Theory of Machines and Mechanisms* New-Castle-Upon-Tyne 1975 , 142-149.

Stevensen, Jr., E. N. "Balancing of Machines", *ASME Journal of Engineering for Industry* vol. 95, No. 2 Nov. 1973 , 650-656.

Streit, D. A. et al., "'Perfect' Spring Equilibrators for Rotatable Bodies", *Journal of Mechanisms, Transmissions, and Automation in Design* vol. 111 Dec. 1989 , 451-458.

Ulrich, Nathan et al., "Mechanical Design Methods of Improving Manipulator Performance", *Proc. 5th Int. Conf. on Advanced Robotics (ICAR '91)* vol. 1, Pisa, Italy Jun. 19, 1991 , 515-520.

Ulrich, Nathan et al., "Passive Mechanical Gravity Compensation for Robot Manipulators", *Proceedings of the 1991 IEEE International Conference on Robotics and Automation* Sacramento, California Apr. 1991 , 1536-1541.

Van Dorsser, Wouter D. et al., "Gravity-Balanced Arm Support with Energy-Free Adjustment", *Journal of Medical Devices* vol. 1, ASME Jun. 2007 , 151-158.

Walsh, G. J. et al., "Spatial Spring Equilibrator Theory", *Mech. Mach. Theory* vol. 26, No. 2, Pergamon Press, Great Britain 1991 , 155-170.

Wang, Jiegao et al., "Static balancing of spatial three-degree-of-freedom parallel mechanisms", *Mechanism and Machine Theory* vol. 34, Elsevier Science Ltd. Jul. 1999 , 437-452.

Ye, Z. et al., "Complete Balancing of Planar Linkages by an Equivalence Method", *Mech. Mach. Theory* vol. 29, No. 5, Elsevier Science Ltd. Great Britain 1994 , 701-712.

* cited by examiner

APPARATUS AND METHOD FOR REDUCED-GRAVITY SIMULATION

BACKGROUND OF THE INVENTION

1. Field of the Invention (Technical Field)

The present invention relates to a gravity-balanced passive apparatus and method to physically simulate perambulation such as walking, hopping, jogging, running, or other movements in reduced gravity condition.

2. Description of Related Art

The design of balancing apparatuses has been an active research topic for several decades. The problem of static and dynamic balancing of linkages has been studied extensively in the past. Static balancing of an apparatus occurs when the links and payload do not exert any torque or force on the joints of the apparatus at any configuration of the apparatus. This condition is also referred to as passive gravity compensation.

Many gravity-compensated serial and parallel manipulators have been designed using counterweights, springs and sometimes cams and/or pulleys. A hybrid direct-drive gravity-compensated manipulator has also been developed. Moreover, gravity-balanced leg exoskeletons used for assisting persons afflicted with hemiparesis to walk have been studied.

Two basic approaches exist for static balancing, namely, using counterweights or using springs. An apparatus has the property of maintaining its mass center at a globally fixed location when using the counterweight approach. Static balancing is achieved in any direction of the Cartesian space of the apparatus. This property is useful for applications in which the apparatus must be statically balanced in all directions, e.g. if the apparatus is to be installed in an arbitrary direction with respect to the gravity acceleration vector. However, the drawback of this balancing method is that additional weights must be added to the system which results in larger inertia forces because of the added mass of the system.

Alternatively, when springs are used for static balancing, the total potential energy, i.e. the gravitational potential energy plus elastic potential energy of the apparatus is maintained constant and the weight of the entire apparatus is balanced with a much smaller total mass than when using counterweights. However, a spring-based balancing apparatus balances only along the direction of the gravity vector, which is unsuitable for some applications.

In space exploration missions, astronauts are often required to perform extra-vehicular activities (EVA). Such activities occur either in a microgravity environment such as on the International Space Station (ISS) or in a reduced-gravity environment such as on the Moon or Mars. To ensure the success of a mission, extensive training is required for the astronauts before a real mission is launched. Astronauts usually spend more than ten times the real EVA time in a ground-based microgravity training facility such as a neutral buoyancy pool when practicing a planned EVA task. Therefore, the training technology and facility have a significant impact on the quality, cost, and time of the required training.

Several existing technologies can be used for EVA training in a simulated reduced gravity condition, such as a neutral buoyancy pool, parabolic-trajectory flight, counter-weight suspension; air-bearing/gimbal support, and virtual reality. All of these technologies have drawbacks when used for physical simulation of reduced gravity conditions. For example, the parabolic-trajectory flight technique can simulate zero-G for only 20 to 30 seconds and thus is too brief for training most of the EVA tasks. The counterweight balanced suspension method can effectively provide only one-degree-of-freedom controlled motion in the vertical direction. The other degrees of freedom are either constrained or do not match motion as it actually occurs in space. An air-bearing supported system performs 2-D or preudo 3-D simulation only. The virtual reality simulations provide a visual effect without much real physical reaction. The neutral buoyancy technology which is the most commonly used existing technology suffers from water viscous drag, sealing problems, and an onerous burden of multiple safety measures.

Existing reduced-gravity simulation technologies either cannot generate a full range of physical motion in space or cannot be easily or economically accessed. Therefore, there exists a need for developing alternate methods for reduced-gravity simulation which are inexpensive and which are easily implemented.

SUMMARY

The present invention comprises a reduced-gravity simulator assembly comprising: a platform comprising at least five degrees of freedom, at least one leg exoskeleton comprising at least three degrees of freedom, at least one spring, and a treadmill. A plurality of connectors comprise spring attachment points. The five degrees of freedom platform comprises at least one parallelogram, at least one strut, at least one backplate, and at least one body harness. The three degrees of freedom leg exoskeleton supports and balances a weight of a human leg, and the five degrees of freedom platform supports an entire human body weight.

An upper portion of the leg exoskeleton attaches to a human thigh and a lower portion of the leg exoskeleton attaches to a human lower leg. The two leg exoskeletons comprise at least three degrees of freedom. A backplate is disposed adjacent to a human torso and hinged to a strut, where the strut comprises an upper strut portion and a lower strut portion.

The reduced-gravity simulator further comprises a plurality of rotating couplings comprising hinges. The reduced-gravity simulator further comprises eleven independent degrees of freedom.

The present invention comprises a method of simulating reduced gravity comprising attaching a reduced-gravity simulator assembly to a human, the assembly comprising a platform comprising at least five degrees of freedom, attaching at least one leg exoskeleton to a human, the exoskeleton comprising at least three degrees of freedom, attaching at least one spring to the simulator; and disposing a treadmill adjacent to a human; adjusting spring attachment points achieving gravity balancing; and reducing gravity to a desired level. The present invention comprises a method further comprising using the treadmill to allow continuous forward walking.

The present invention comprising a reduced gravity simulator assembly that attaches to the human by attaching a human torso to a backplate, allowing the torso to freely move in five degrees of freedom, supporting at least one human leg by the three-degrees-of-freedom exoskeleton allowing free movement of the leg, and providing redundant degrees of freedom about the Z axis to allow ergonomic comfort while the human is walking.

The present invention comprises a method for adjusting springs for gravity balancing comprising sliding the spring attachment points and measuring pressure until the measured pressure underneath the human foot is completely gone but the foot still touches the treadmill, changing the body and/or leg pose, and repeatedly sliding the spring attachment points until required balancing is achieved. The pressure is measured manually or measured automatically by installing an actuated spring adjustment device for each spring.

The method of the present invention further comprises the steps of scaling the spring attachment points based on the percentage of gravity which is to be reduced and retaining a percentage of the pressure under a foot of the human because partial gravity is still present.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE PREFERRED EMBODIMENT

The present invention comprises an apparatus and method for gravity-balanced apparatuses for training humans for space exploration and other applications. The embodiment of the simulation apparatus is inexpensive to build and safe to operate and adaptable to numerous applications, including but not limited to theme parks, museums, training facilities, educational/research labs, and others, for people to experience walking and other perambulations in lower or zero gravity environments. The present invention is statically-balanced and comprises a spring apparatus that is easily adjusted. An embodiment of the present invention provides an apparatus and method for simulating walking in a zero-gravity or reduced-gravity environment.

The present invention relates to methods and apparatuses for using a statically-balanced passive apparatus to simulate walking, running, jumping, hopping, or other movement in a zero or reduced gravity environment. The apparatus is useful for astronaut training and for manned planetary exploration missions.

The present invention comprises a passive multi-DOF spring-enforced parallel mechanism, without any hydraulic, pneumatic, electrical, magnetic, or other active or powered components. The present invention is inexpensive to build, easy to operate, and safe to use.

The present invention uses the principle of maintaining constant potential energy to statically balance the gravity force at any working configuration of the apparatus. The apparatus balances full or partial gravity simply by adjusting the stiffness values or the attachment locations of the springs. It balances not only the gravity force applied on the torso of the human subject but also the gravity forces applied to the subject's legs at any leg configuration. Adding a treadmill, the apparatus easily simulates free and continuous walking, running, and jumping/hopping activities in a zero or reduced gravity condition. The present invention has better dynamics performance because it eliminates actuators and is made of lightweight materials.

The present invention comprises a reduced-gravity apparatus, which uses spring-based gravity-balancing technology to simulate human walking or jumping in a reduced-gravity environment. The apparatus is capable of assisting astronauts training for EVA. The reduced-gravity system of the present invention compensates for the full or partial gravitational effect of the trainee, providing a similar experience or feeling as in a real reduced-gravity environment.

The invention has been studied and developed by means of simulation and nonhuman experiments. In the simulation, a physical human is modeled as a multi-body dynamical system of 54 degrees of freedom. The dynamic responses of a human walking or jumping with the reduced-gravity apparatus are simulated and analyzed. The simulation results are compared to those of the same human body on free walking and jumping in the reduced gravity environment.

Figure 1:
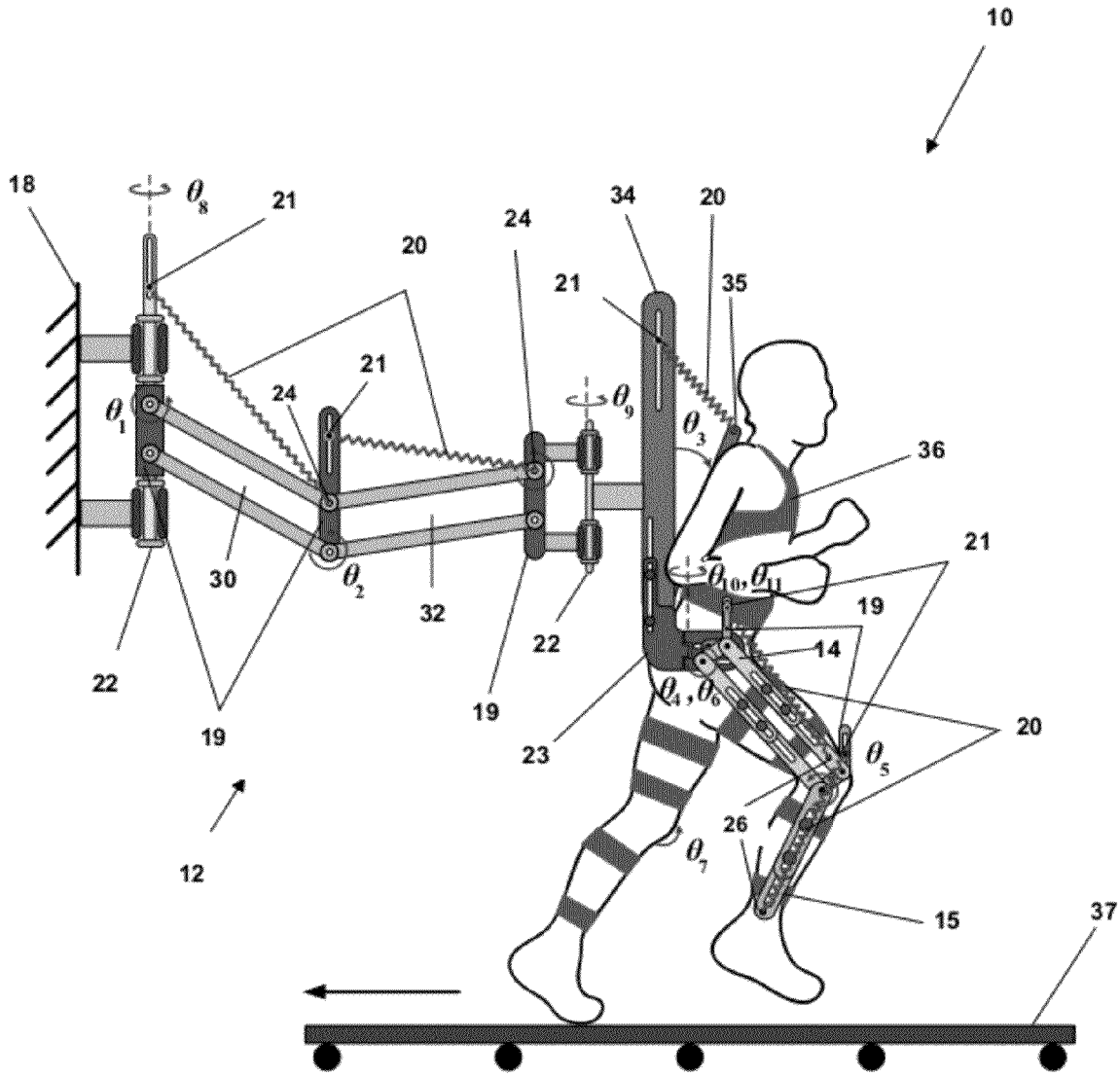
FIG. 1 is a schematic representation of an embodiment of the passive apparatus based zero-G or reduced-G training facility of the present invention.

A reduced-gravity simulation approach for astronaut training is illustrated in a simulator shown in FIG. 1, and is based on a static balancing technology. Static balancing of an apparatus refers to the status that no joint forces or torques are required to keep the apparatus in equilibrium for all configurations within its workspace. The statically-balanced apparatus of the present invention totally or partially compensates for the gravitational force on an astronaut who is attached to the apparatus to train to walk or do other tasks in a space environment. The embodiment of the present invention comprises a reduced-gravity simulator (RGS) comprising static balancing technology. The present invention allows different levels of gravitational force to be compensated for according to training needs. Lunar activity is simulated by removing ⅚ of terran gravity and Mars activity is simulated by removing 62% of terran gravity.

The term "treadmill", as used throughout the specification and claims is intended to include any surface (including the ground or an apparatus) useful for leg movement, including but not limited to a walking, running, jogging or jumping platform or moving or moveable surface.

The term "spring", as used throughout the specification and claims is intended to include any spring or spring-like or elastic device that results in a spring or spring-like motion.

FIG. 1 illustrates an embodiment of an embodiment of the training system of the present invention comprising multi-DOF reduced gravity assembly 10, comprising 5-DOF platform 12, two 3-DOF leg exoskeletons comprising slidingly adjustable upper portion 14 for supporting the thigh and slidingly adjustable lower portion 15 for supporting the lower leg, and treadmill 37. The 5-DOF platform balances the weight of an entire human body and the 3-DOF exoskeletons balance the two human leg weights. The 5-DOF platform 12 comprises first parallelogram 30 and second parallelogram 32, strut comprising upper strut 34 and lower strut 23, backplate 35 attached to and supporting a human torso, and body harness 36 for attaching the human torso to the backplate. Treadmill 37 simulates forward motion while a human is walking on the treadmill. The reduced gravity assembly 10 is disposed on fixed base 18, and comprises balancing springs 20 and rotating couplings comprising hinges 22 allowing rotation about vertical axes. Spring attachment points 21 are slidably attached to one point of a first connector 19 and rotationally attached to a point 24 of a second connector 19 in the 5-DOF platform 12. Spring attachment points 21 are slidably attached to one point of a first connector 19 and fixably attached to a second point 26 on upper portion 14 as well as lower portion 15 of 3-DOF leg exoskeleton.

Different gravity forces are preferably balanced by adjusting the stiffness values or attachment locations of springs 20 in the system according to training needs such as removing ⅚ of the gravity for simulating a lunar activity of 62% of the gravity for an activity on the surface of Mars.

In another embodiment, the apparatus and method use a gravity-balanced apparatus and treadmill to simulate a human walking in a zero-G or reduced-G environment. The preferred statically balanced apparatus has nine degrees of freedom, which are capable of balancing partial or full earth gravitation on the ground for any working configuration of the apparatus. Preferred static-balancing conditions are derived which are used for application of a gravity-force balancing system.

Features of embodiments of the invention comprise:

1) A fully passive spring-enforced parallel apparatus, without any hydraulic, pneumatic, electrical, magnetic, or other active or powered components;

2) Maintaining constant potential energy to statically balance the gravity force at any working configuration;

3) Balancing full or partial gravity by adjusting the stiffness values or the attachment locations of springs;

4) Balancing not only the gravity force applied on the torso of the human subject but also those forces applied on the subject's legs at any leg configurations;

5) A treadmill that simulates free and continuous walking, running, jumping/hopping or other perambulations in a zero or reduced gravity condition; and 6) Better dynamics performance because it has less inertia than other existing devices designed for similar purposes.

Simulating reduced gravity is achieved on the embodiment of the present invention by attaching a human to the reduced-gravity simulator assembly for whole body simulation via harness 36, adjusting attachment points 21 of springs 20 to achieve gravity balancing, even when the human mass distribution is unknown. Gravitational force is reduced to any desired level.

A whole-body simulation comprises attaching the human torso to backplate 35, thus allowing the torso to freely move in five degrees of freedom. The only missing DOF is roll motion about the X axis, which does not exist in human walking. The two human legs are supported by the 3-DOF leg exoskeletons comprising upper portion 14 and lower portion 15, allowing free walking of the legs. Redundant degrees of freedom are provided about the Z axis in order to allow ergonomic comfort while the human is walking. Treadmill 37 allows continuous forward walking in unison with reduced gravity system 10.

Springs 20 are adjusted for balancing gravity by attaching the human to reduced gravity system 10, sliding spring attachment points 21 until the pressure underneath both human feet is completely eliminated while the feet still touch the ground or treadmill. A force plate is used to measure the pressure. The human body and/or leg pose is changed and the spring attachment points are again moved by sliding until the required balancing is achieved. These steps are done either manually or automatically. If automation is desired, an actuated spring adjustment device is installed for each spring.

Spring attachment points 21 are scaled based on the percentage of gravity which is to be reduced, if simulation of the gravitational force of Mars, the Moon, or Earth is desired. The pressure under the feet of the person will no longer be zero when the adjustment is done because partial gravity is still present.

An embodiment of the present invention comprises a system comprising a 5-DOF platform, two 3-DOF leg exoskeletons, and a treadmill. The 5-DOF of the platform are the three translational degrees of freedom and two rotational DOF (i.e., the pitch and yaw rotations). The three DOF of the leg exoskeleton are the two rotational DOFs for the hip joint and one DOF for the knee joint. The 5-DOF platform is used to support and balance the body weight of a person interacting with the system and the 3-DOF exoskeletons are used to support and balance the weights of the two legs of the person. The treadmill is used to simulate the forward motion while the person is walking.

The statically-balanced apparatus comprises three degrees of freedom in each of the leg exoskeletons and five degrees of freedom in the support platform, and therefore eleven degrees of freedom combined, and is capable of balancing partial or full earth gravitation on the ground for any working configuration of the apparatus. As can be appreciated by those skilled in the art, additional or fewer degrees of freedom may be added or eliminated to or from the various components. Gravity balancing conditions for designing such an apparatus are derived from the total potential energy of the system.

An embodiment of the present invention comprises a mechanical method of simulating walking in zero-gravity or reduced-gravity condition using a passive apparatus comprising a statically-balanced apparatus in which the weight of the moving parts does not produce any force or torque at the joints at any configuration of the apparatus. Therefore, the statically-balanced apparatus comprises a mechanical system to balance the gravity force of the body and legs of an astronaut or any other person who performs walking training on earth to prepare for space activities.

Figure 2:
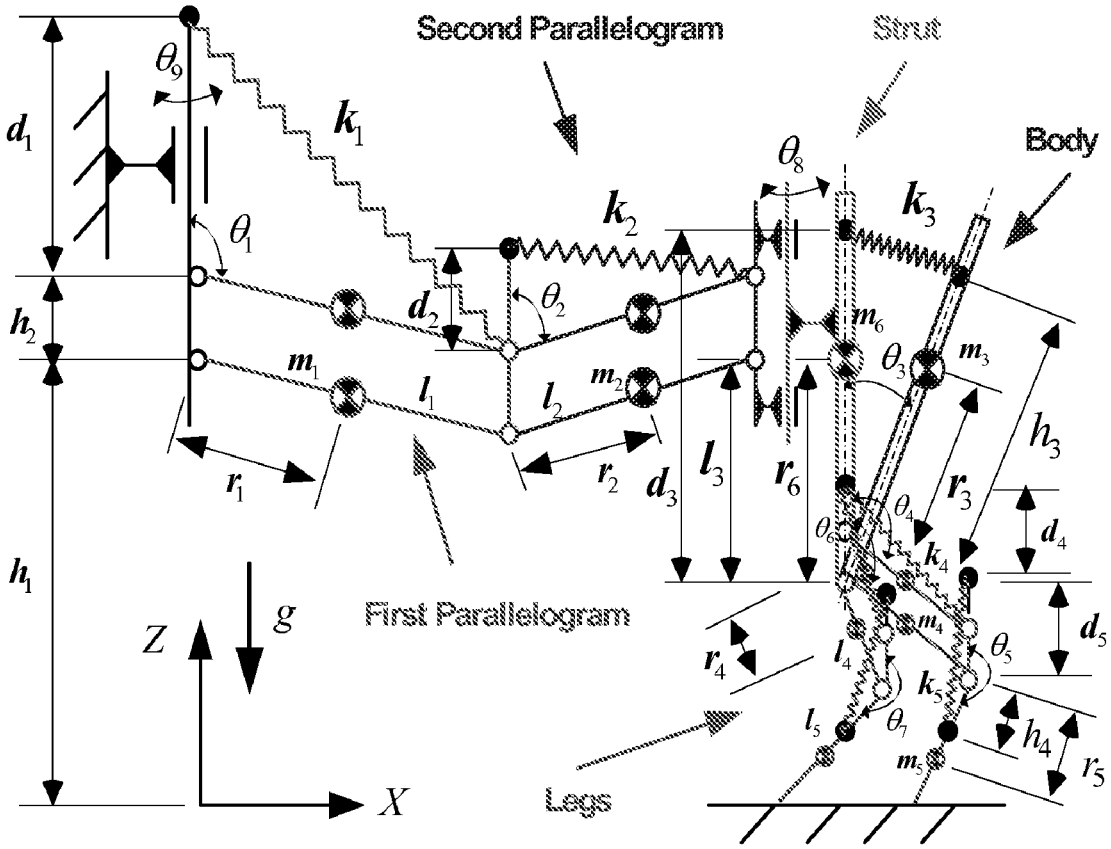
FIG. 2 is a schematic illustration of the static-balancing training apparatus of the present invention.

FIG. 2 is a kinematics illustration of an embodiment of the present invention comprising a gravity-balanced passive apparatus for human training. The body harness and leg exoskeletons respectively include the torso and the legs of the human while training with the equipment. The system comprises a total of eleven degrees of freedom.

The apparatus excluding the human body has a total of eleven degrees of freedom (DOFs) represented by joint angles $\theta_1 \sim \theta_9$ as shown in FIGS. 1 and 2. The $\theta_{10}$ and $\theta_{11}$ angles do not show up in FIG. 2 because they do not affect the potential energy of the system. Each leg exoskeleton is fixed on each of the human's upper leg (thigh) and lower leg (crus), so the three DOFs provided by each leg's exoskeleton are actually associated with the hip and knee joints of the person. The hip joint rotates about two axes and the knee joint rotates about one axis, as indicated in FIG. 1.

To analyze the apparatus, an inertial reference frame X-Y-Z is fixed to the ground with the Y-axis pointing into the paper as depicted in FIG. 2 and the Z-axis pointing vertically upward, and the X-axis pointing to the right. The angle $\theta_i$, (i=1, 2, . . . , 9) denotes the angular displacement of the ith degree of freedom. All the angular displacements are angles measured from the Z-axis to the center lines of the corresponding joints except for the $\theta_8 \sim \theta_{11}$ angles which are angles from the X-axis to the center line of the link and measured in the X-Y plane. These four angles provide extra degrees of freedom for the human to improve maneuverability but they do not affect the analysis because they are independent of the potential energy of the system.

The torso of the human (the link with the mass $m_3$) preferably has three translational degrees of freedom along with the X, Y, and Z directions and two rotational degrees of freedom about the Y and Z axes. Each of the two legs preferably has three rotational degrees of freedom, two with the hip joint and the third one with the knee joint.

The direction of the gravitational acceleration is preferably parallel to the negative direction of the Z-axis. Seven springs are preferably used for balancing the weights of the apparatus and the attached human. The first spring (with stiffness $k_1$) is disposed between the two vertical bars of the first parallelogram apparatus; the second spring (with stiffness $k_2$) is disposed between the vertical bars of the second parallelogram apparatus. The third spring (with stiffness $k_3$) is disposed between the vertical strut and the body harness of the human. The fourth and fifth springs (stiffnesses $k_4$ and $k_5$) are preferably attached to the upper and lower parts of the leg exoskeleton, respectively. Identical springs are preferably attached to both leg exoskeletons under the assumption that both legs of the human have the same mass distribution.

The reduced-gravity apparatus comprises seven springs to compensate the weights of the apparatus and the attached human. The arrangement of the springs is also shown in FIG. 2 and alternately comprises a plurality of other arrangements and assemblies of springs due to assembly/manufacturing requirements. The stiffnesses of the springs are denoted by parameters $k_1$~$k_7$. Among these springs, the first three (with stiffnesses $k_1$~$k_3$) are attached to the platform for balancing the weight of the human and the apparatus. The other four (with stiffnesses $k_4$~$k_7$) are installed on the two leg exoskeletons to compensate the weight of the two legs and the exoskeletons themselves. The two legs of the human are assumed to be identical in both geometrical structure and inertial property and thus, the springs on both legs are also identical.

An apparatus is statically balanced when the total potential energy contributed by both the gravity and the springs remains constant for all working configurations of the apparatus. This is mathematically equivalent to equation (1), where $V_{MG}$, $V_{BG}$ and $V_S$ represent the gravitational potential energy of the apparatus, gravitational potential energy of the human, and the spring potential energy, respectively. Under the conditions given by (1), the gravity effect is reduced to zero.

$$V_{Total}=V_{MG}+V_{BG}+V_S=\text{Constant} \tag{1}$$

Similarly, if only a part of the gravity effect on the human is required to be removed, the following condition exists, where the factor ρ is defined as the ratio of the removed gravity over the original gravity. Thus, ρ is also the percentage of the gravity to be balanced out. Note that p is a factor of only the potential energy of the human body because only the human requires a reduced gravity while the entire apparatus must have zero gravity at all times.

$$V_{BG}+\rho V_{BG}+V_S=\text{Constant} \tag{2}$$

When the X-Y plane possesses zero gravitational potential energy, the gravitational potential energy of each part of the apparatus is expressed as follows:

$$V_{plgm1} = 2(h_1 + r_1\cos\theta_1)m_1 g + h_2 m_1 g \tag{3}$$

$$V_{plgm2} = 2(h_1 + l_1\cos\theta_1 + r_2\cos\theta_2)m_2 g + h_2 m_2 g$$

-continued $$V_{strut} = (h_1 + l_1\cos\theta_1 + l_2\cos\theta_2 - l_3 + r_6)m_6 g$$

$$V_{body} = (h_1 + l_1\cos\theta_1 + l_2\cos\theta_2 - l_3 + r_3\cos\theta_3)m_3 g$$

$$V_{leg1} = 2(h_1 + l_1\cos\theta_1 + l_2\cos\theta_2 - l_3 + r_4\cos\theta_4)m_4 g + (h_1 + l_1\cos\theta_1 + l_2\cos\theta_2 + l_4\cos\theta_4 - l_3 + r_5\cos\theta_5)m_5 g$$

$$V_{leg2} = 2(h_1 + l_1\cos\theta_1 + l_2\cos\theta_2 - l_3 + r_4\cos\theta_6)m_4 g + (h_1 + l_1\cos\theta_1 + l_2\cos\theta_2 + l_4\cos\theta_6 - l_3 + r_5\cos\theta_7)m_5 g$$

where $V_{plgm1}$, $V_{plgm2}$, $V_{body}$, $V_{leg1}$, $V_{leg2}$ and $V_{strut}$ are, respectively, the gravitational potential energies of the first parallelogram, the second parallelogram, the body and its harness, the left leg with its exoskeleton, the right leg with its exoskeleton and the strut; $m_1$ and $m_2$ are the masses of the links in the first and second parallelograms; $m_3$ represents the mass of the body and its harness; $m_4$ and $m_5$ are the masses of the upper and lower parts of one leg and its exoskeleton; $m_6$ is the mass of the strut disposed to support the weight of the astronaut. $l_1$ and $l_2$ are the lengths of the links of the first and second parallelograms; $l_3$ is the distance from the joint of the second parallelogram to the joint connecting the strut, the body and the two leg exoskeletons in Z direction; $l_4$ is the length of the upper part of a leg exoskeleton, which comprises a parallelogram; $r_1$ and $r_2$ are respectively the distances from the pivoting joints to the mass center of the links in the first and second parallelograms; $r_3$ is the distance from the joint connecting the body and strut to the mass center of the body; $r_4$ and $r_5$ are the distances between the pivoting joints to the mass center of the upper and lower links of the leg exoskeletons; $r_6$ is the distance from the joint connecting the strut and body harness to the mass center of the strut, and $h_1$ is the vertical distance from the joint of the first parallelogram to the X axis; $h_2$ is the distance between the two links of the first parallelogram; $h_3$ is the distance from the joint connecting the body harness and strut to the attachment point of the spring connecting the body and strut; $h_4$ is the distance from the joint connecting the upper and lower parts of a leg exoskeleton to the attachment point of the fifth spring; $h_5$ is the distance between the two links of the leg parallelogram; $d_1$ and $d_2$ are respectively the distances from the joints of the first and second parallelograms to the attachment points of the first and second springs; $d_3$ is the distance from the joint connecting the body harness and strut to the attachment point of the third spring on the strut. $d_4$ is the distance from the joint of the upper part of the leg to the attachment point of the fourth spring; $d_5$ is the distance between the two attachment points of the fifth springs.

The portion of each spring shown in FIG. 2 is preferably the whole stretch of the spring (the rest of the spring is not shown in the Figure). Such a spring design is implemented preferably by using cables and pulleys in the spring assembly. The elastic potential energy of each spring is written as the following equation (4), where $V_{s1}$, $V_{s2}$, and $V_{s3}$ are the potential energies of the first, second, and third springs, respectively. $V_{s45}$ is the potential energy of the fourth and fifth springs and $V_{s67}$ is that of the sixth and seventh springs.

$$V_{s1} = \frac{1}{2}k_1(d_1^2 + l_1^2 - 2d_1 l_1\cos\theta_1) \tag{4a}$$

$$V_{s2} = \frac{1}{2}k_2(d_2^2 + l_2^2 - 2d_2 l_2\cos\theta_2) \tag{4b}$$

-continued $$V_{s3} = \frac{1}{2}k_3(d_3^2 + h_3^2 - 2d_3h_3\cos\theta_3) \tag{4c}$$

$$V_{s45} = \frac{1}{2}k_4(d_4^2 + l_4^2 - 2d_4l_4\cos\theta_4) + \frac{1}{2}k_5(d_5^2 + h_4^2 - 2d_5h_4\cos\theta_5) \tag{4d}$$

$$V_{s67} = \frac{1}{2}k_4(d_4^2 + l_4^2 - 2d_4l_4\cos\theta_6) + \frac{1}{2}k_5(d_5^2 + h_4^2 - 2d_5h_4\cos\theta_7) \tag{4e}$$

The total potential energy of the apparatus, denoted by V, is defined as the sum of the gravitational and elastic potential energy and is written as equation (5).

$$V = V_{plgm1} + V_{plgm2} + V_{body} + V_{strut} + V_{leg1} + V_{leg2} + V_{s1} + V_{s2} + V_{s3} + V_{s45} + V_{s67} \tag{5}$$

Expressing the total potential energy in terms of the configuration variables, namely, the joint angles $\theta_i$, (i=1, 2, . . . , 7), equation (5) becomes equation (6), or alternately expressed as equation (7).

$$V = C_0 + \sum_{i=1}^{7} C_i\cos\theta_i \tag{6}$$

$$V_{Total} = V_{MG} + \rho V_{BG} + V_S = C_0 + \sum_{i=1}^{7} C_i\cos\theta_i \tag{7}$$

The variables in equation (7) are defined as follows.

$$C_0 = (2h_1 + h_2)(m_1 + m_2)g + (h_1 - h_3)(M_m + \rho M_B)g + r_6m_6g + 2h_5m_4g + \frac{1}{2}k_3(d_3^2 + h_3^2) + k_5(d_5^2 + h_4^2) + k_4(d_4^2 + l_4^2) + \frac{1}{2}\sum_{i=1}^{2} k_i(d_i^2 + l_i^2) \tag{8a}$$

$$C_1 = 2m_1r_1g + l_1(2m_2g + M_Mg + \rho M_BG - k_1d_1) \tag{8b}$$

$$C_2 = 2m_2r_2g + l_2(M_Mg + \rho M_BG - k_2d_2) \tag{8c}$$

$$C_3 = \rho m_3r_3g - k_3d_3h_3 \tag{8d}$$

$$C_4 = (2m_4 + \rho m_{ul})r_4g + (m_5 + \rho m_{ll})l_4g - k_4d_4l_4 \tag{8e}$$

$$C_5 = (m_5 + \rho m_{ll})r_5g - k_5d_5h_4 \tag{8f}$$

$$C_6 = C_4 \tag{8g}$$

$$C_7 = C_5 \tag{8h}$$

$$M_m = 4m_4 + 2m_5 + m_6 \tag{8i}$$

$$M_B = m_3 + 2m_{ul} + 2m_{ll} \tag{8j}$$

The term $m_a$ is the total mass of the human and the harness and exoskeletons used to support the human body and legs to the balancing system. The value of $m_a$ varies from human to human. The joint angles $\theta_8$ and $\theta_9$ do not appear in equations (8). These two angular displacements affect only the x and y location of the mass center of the device and have no effect on the z location of the mass center. These two variable angles do not affect the total potential energy of the system. Similarly, parameters $h_1$, $h_2$ and $l_3$ do not influence the potential energy. The values of these parameters are arbitrarily chosen for other purposes in the design of the system.

The total energy, as given by Eq. (7), is constant for all configurations when all the coefficients in the second term of the right-hand side of Eq. (7) become zero. In other words, the conditions for partial gravity balancing (i.e. gravity reduction) are the following. From equation (8), the second term disappears and the total potential energy equals $C_0$ which is independent from any joint angle. When all the coefficients in the second term are zeros, the potential energy of the entire system is constant. The static balancing conditions for the system are:

$$C_i=0,\ i=1,2,\ldots,5 \tag{9}$$

Based on these conditions, a set of spring parameters is selected as follows.

$$k_1 = \frac{2m_1r_1 + l_1(2m_2 + m_a)}{l_1d_1}g \tag{10}$$

$$k_2 = \frac{2m_2r_2 + l_2m_a}{l_2d_2}g$$

$$k_3 = \frac{m_3r_3}{h_3d_3}g$$

$$k_4 = \frac{2m_4r_4 + m_5l_4}{l_4d_4}g$$

$$k_5 = \frac{m_5r_5}{h_4d_5}g$$

Such springs preferably keep the total potential energy of the system constant for any configuration and the gravity force of the resulting system is preferably completely compensated.

A set of springs defined by equation (10) balances the apparatus with a particular person where the preferred springs' stiffness values depend on mass $m_a$ which includes the human mass. In one embodiment, when the apparatus is used by a different person, a new set of springs with different stiffness values have to be installed, which is inconvenient. In another embodiment, the same set of springs is used for everyone and the springs' attachment points are preferably adjustable to change the values of $d_i$ (i=1, 2, . . . , 5) for different persons. This latter embodiment is more preferable in practice. Another embodiment of this adjustment of the spring attachment locations comprises automation using robotics technology Such a set of springs reduces the gravitational potential energy of the human by a ratio ρ for all configurations. When ρ becomes one, it means that the gravity of the human attached to the apparatus is totally compensated, and therefore, the human should experience a zero-gravity condition.

An adaptive reduced-gravity facility comprises a reduced gravity simulation system. An adaptive reduced-gravity, human motion and dynamics experimental facility was used to conduct research on aerospace, bioengineering, and healthcare. Computer-based simulation provides an analysis of the reduced gravity simulation system. An instrumented nonhuman test investigates engineering principles and safety features. Ergonomics experiments use human subjects to evaluate the reduced gravity system and assess any human factors involved.

Figure 3:
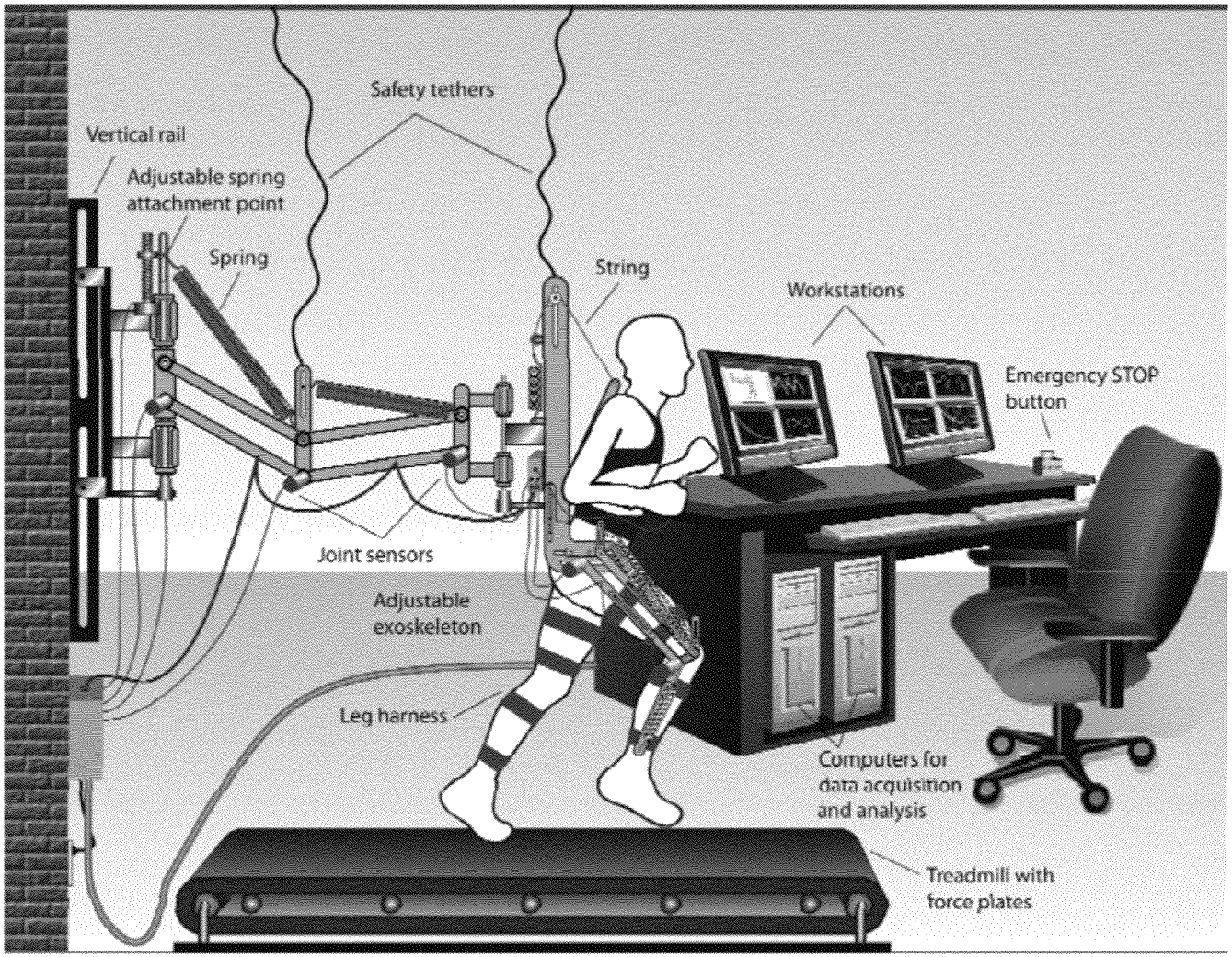
FIG. 3 is a schematic illustration of an adaptive reduced-G simulation facility.

FIG. 3 is a schematic illustration of the adaptive reduced-G simulation facility. Mathematical modeling and simulation is used to enhance understanding of the physical world from nanotechnology to astrophysics. The complexity of the mechanics of human bodies requires math modeling and simulation in order to investigate biomedical applications. A human body can be seen as an articulated multibody dynamical system with many degrees of freedom. Such a living system is more difficult to model and analyze than other physical systems like robots and vehicles.

The facility makes possible the measurement and understanding of force-motion relations of human bodies. Currently available human motion capture systems accurately acquire kinematics data only, although some can capture limited force data (e.g., the ground reaction forces) but the measurement is insufficient for constructing accurate in-situ human dynamics models.

The reduced-G facility provides a space to implement methods to identify human dynamics parameters from the simple exercise of a living human. Further, medical research has shown that robotics devices can help improve neural rehabilitation and physiotherapy. The facility provides the medical community with significant improvements to currently existing rehabilitation devices.

Existing facilities (e.g., neutral buoyancy lab, C-9 flight, etc.) are primarily reserved for training astronauts because they are complicated systems and expensive and difficult to operate. The embodiment of the present invention provides an innovative and low-cost alternative to current reduced-G simulation technologies for the anticipated growing need of future manned space exploration missions to Moon and Mars.

The facility also comprises a motion simulator for training space tourists for the projected 10,000~20,000 commercial space travelers by 2020. There is significant benefit to having training facilities available in which potential space travelers train in reduced-G motion simulators prior to the flight.

The facility comprises a safe and energy efficient passive mechanical system; a seamless reduction of the gravity force to any level from 0-g to 1-g; an active adaptation capability to accommodate individuals' different inertia distributions; equipment to measure joint motions (angles and velocities) without occlusion; a 3D motion capture apparatus for both free and constrained human activities; and multiple safety protection measures for human safety.

The facility comprises the following research applications: reduced-G physical simulation and training technology; human-body dynamics modeling and simulation; human-machine interface and robotics; human anthropometric database and computer animation; human-machine interface, human factors and ergonomic optimization; and 3D human motion analysis and performance optimization.

The facility comprises the following industrial applications: training astronauts for EVA tasks on the Moon and Mars; training space travelers for motion in reduced-gravity environment; neural rehabilitation of people with walking impairment; human motion capture for computer animation, movie and gaming industry; and entertainment for kids to experience a simulated 0-G or reduced-G feeling.

The dynamic performance of the reduced-gravity simulator, which is based on the technology of static balancing of gravity force, was investigated as shown in the following examples.

Example 1

A non-limiting example of a system which vertically adjusts the spring attachment points $A_1, A_2, \ldots,$ and $A_5$ (as illustrated in FIG. 2) based on the mass of the person on the apparatus follows. The adjustment is based on the calculations given in equations (11). It is preferable to mechanically make a spring's attachment points adjustable.

$$d_1 = \frac{2m_1r_1 + l_1(2m_2 + m_a)}{l_1k_1}g \tag{11}$$

$$d_2 = \frac{2m_2r_2 + l_2m_a}{l_2k_2}g$$

$$d_3 = \frac{m_3r_3}{h_3k_3}g$$

$$d_4 = \frac{m_4r_4 + m_5l_4}{l_4k_4}g$$

$$d_5 = \frac{m_5r_5}{h_4k_5}g$$

Example 2

A non-limiting example of a system of an embodiment of the present inventions for the conditions given in equations (10) and (11) was based on the assumption that all the gravity forces were balanced. The resulting apparatus was used for simulating zero-G scenarios. For planetary exploration, to simulate a reduced-G scenario as opposed to the zero-G case, there is a partial gravity balancing, done by replacing the gravity acceleration term g in equations (10) and (11) with the term ρg where ρ is a parameter that represents the ratio (or percentage) of the Earth gravity to be balanced.

Example 3

A non-limiting example of a system to simulate walking on the Moon surface where the gravity is only ⅙ of the Earth gravity, has a corresponding ρ set to the following.

$$\rho = \left(1 - \frac{1}{6}\right) = \frac{5}{6} \tag{12}$$

Example 4

A non-limiting example of a system for static balancing conditions used for a kinematics design of an apparatus was statically balanced using springs. The following parameters of the apparatus were known, i.e., $$\begin{aligned} &m_1 = m_2 = 10 \text{ kg} \\ &m_3 = 60 \text{ kg}; m_4 = 15 \text{ kg}; m_5 = 10 \text{ kg}; m_6 = 20 \text{ kg} \\ &l_1 = l_2 = 0.5 \text{ m}; l_4 = 0.35 \text{ m}; l_5 = 0.35 \text{ m} \\ &h_3 = 0.6 \text{ m}; h_4 = 0.1 \text{ m} \\ &d_1 = d_2 = 0.4 \text{ m}; d_3 = 0.6 \text{ m}; d_4 = 0.2 \text{ m}; d_5 = 0.15 \text{ m} \\ &r_1 = r_2 = 0.25 \text{ m}; r_3 = 0.5 \text{ m}; r_4 = 0.25 \text{ m}; \\ &r_5 = 0.3 \text{ m}; g = 9.81 \text{ m/s}^2 \end{aligned} \tag{13}$$

The above mass values include the mass of a regular person attached to the apparatus. Substituting these parameters into Equation (10), the results were:

$$\begin{aligned} &k_1 = 4659.8 \text{ N/m}; \quad k_2 = 4169.3 \text{ N/m} \\ &k_3 = 817.5 \text{ N/m}; \quad k_4 = 1541.6 \text{ N/m} \\ &k_5 = 2943 \text{ N/m} \end{aligned} \tag{14}$$

The subject human attached to the apparatus preferably felt no gravity force while he moved with the apparatus. The preferred described apparatus is based on kinematics and statics only, without considering any dynamics and friction aspects of the system. The human subject felt the inertia and friction forces when he/she interacted with the system. The inertia forces/torques of the person were kept as is because they were caused by the inertia property and dynamic motion of the person, which was independent from the gravitation. In an embodiment, the inertia forces/torques caused by the inertia of the apparatus itself were not present in a real reduced-G environment and thus were eliminated. Compensating an inertia force is more difficult than compensating a gravity force and was done using an active control strategy. The inertia force of the apparatus is decreased when the apparatus comprises lightweight materials.

In another embodiment, joint friction torques were eliminated because they are not present if the apparatus is not attached to the person. A joint friction torque was decreased to a low level with proper mechanical design and proper lubrication of the joint.

Figure 4A:
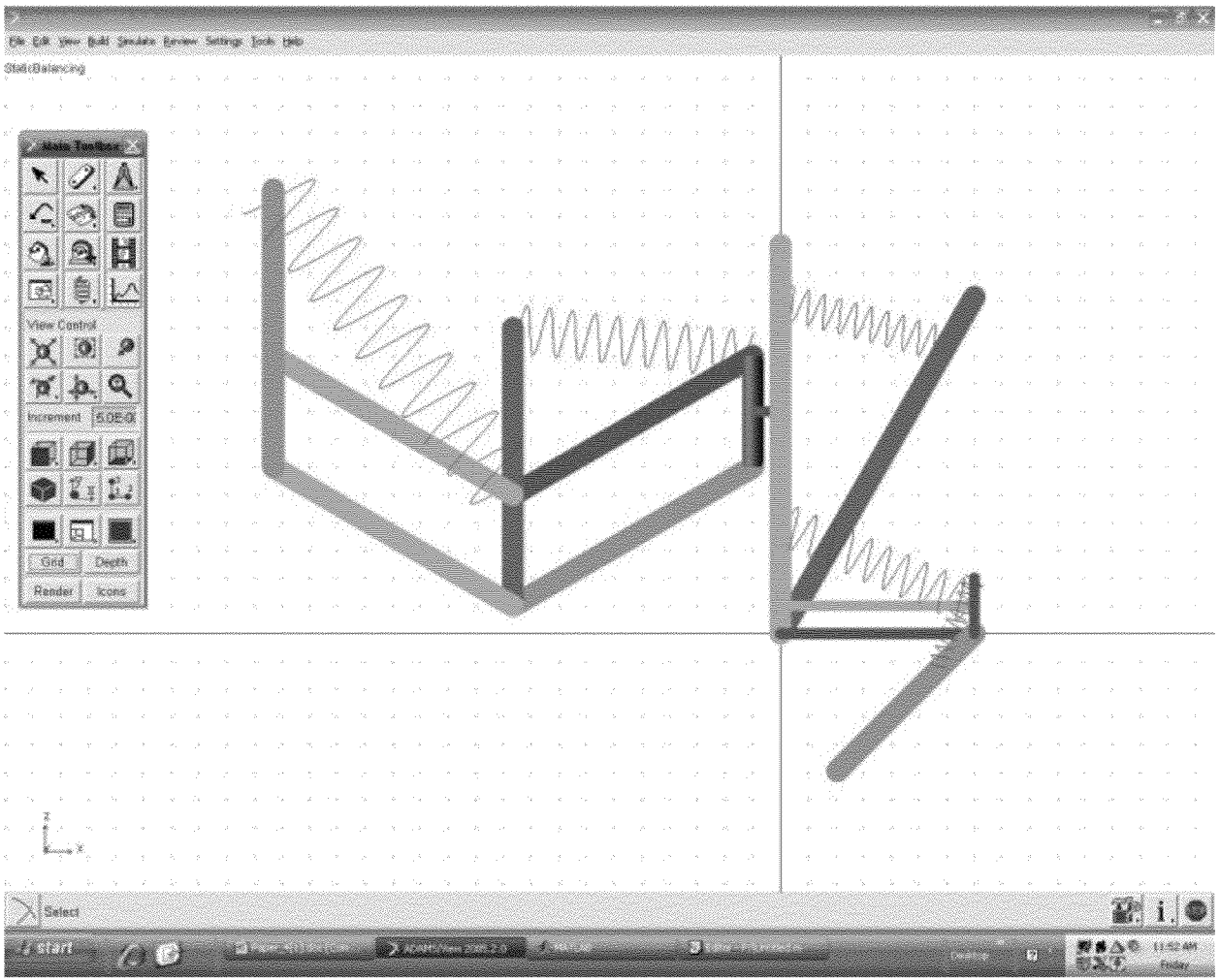
FIG. 4 is a simulation model of an embodiment of the present invention implemented on MSC ADAMS™ software for simulation study.
Figure 4B:
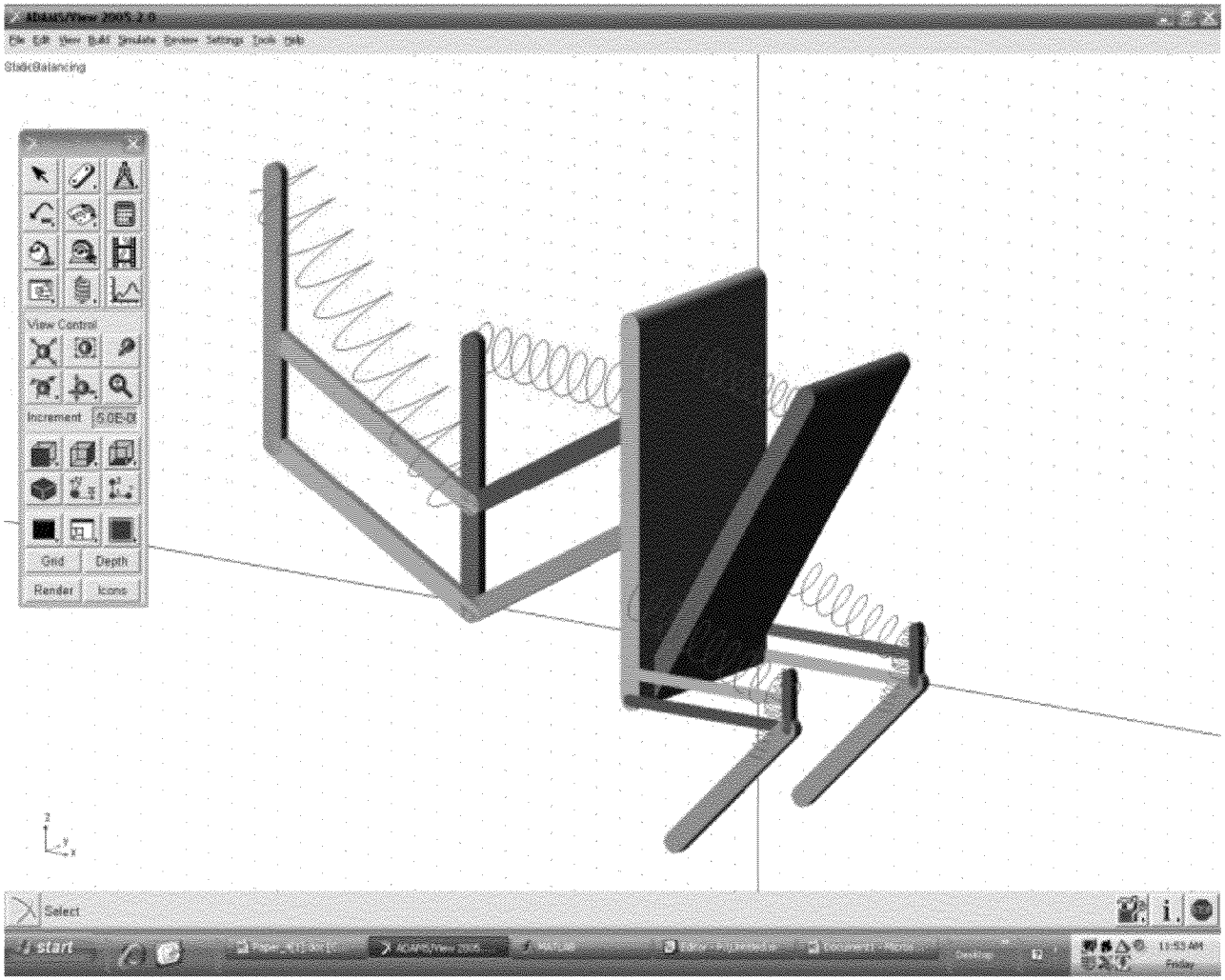

Using the above spring stiffness values and preferred dimensional and mass parameters, the gravity force of the system including the person was completely balanced. A dynamic simulation model of the apparatus was implemented for verification using MSC ADAMS™ software, as shown in 43. FIG. 4*a* illustrates a side view of the simulation results. FIG. 4*b* illustrates a front perspective view of the results of the simulation results. The limitations of the software used to model the results in FIG. 4 resulted in using fewer variables than are evident in FIG. 1. The simplified computer model was used to verify the theory that zero-gravity could be achieved. The dynamic simulation results illustrated in FIG. 4 shows that the apparatus remained at an arbitrarily assumed initial configuration without moving in the gravity field. Such a result indicated that the gravitational force was fully compensated, otherwise, the apparatus would be observed as incapable of staying at any given configuration without moving.

Example 5

Computer Simulation, Dynamic Simulation Model

To fully verify the effectiveness of the reduced-gravity simulator for astronaut training, hardware experiments with human subjects should eventually be conducted. However, for safety consideration, sufficient evidence regarding the feasibility and likelihood benefits of the new technology must be first demonstrated by other means such as computer simulations and nonhuman subject testing before a human subject test is planned. To this end, a simulation based feasibility study of the invention was conducted. In the simulation study, the dynamics behavior of the new system was quantitatively assessed.

Due to the complexity and elasticity in its structure, the human body was not easy to mathematically model accurately. The commercial software LifeMOD™ provided a powerful capability of constructing a dynamics model of a human body. LifeMOD™ is a plug-in toolbox for the multibody dynamics simulator MSC ADAMS™. With this software, a dynamics simulation model including a human model and the gravity-reduction apparatus was implemented for the study.

Figure 5:
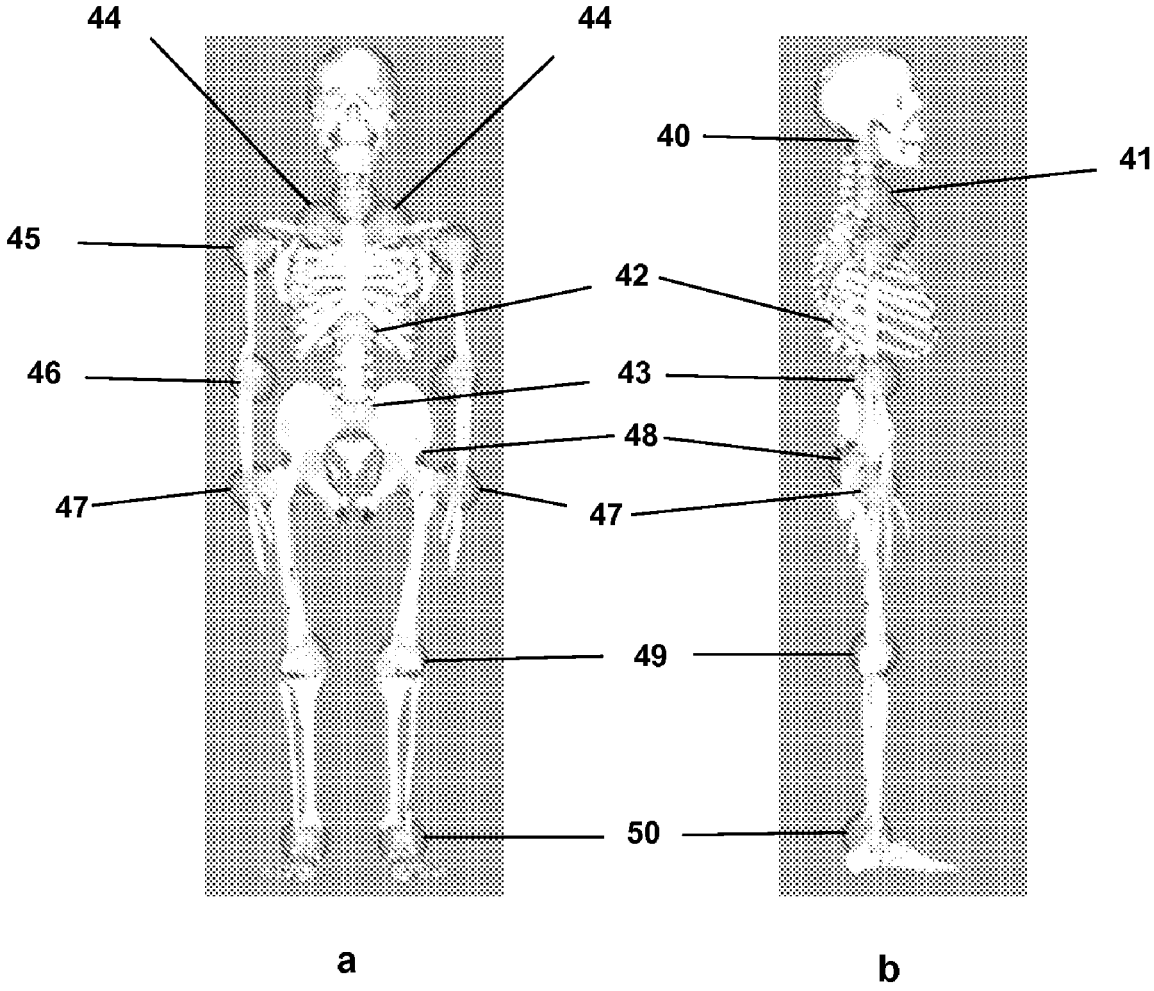
FIG. 5 is an illustration of a human skeleton model implemented on LifeMOD™ for simulation-based study of the present invention.

The human model, as illustrated in FIG. 5, was modeled as a multibody system consisting of 19 rigid segments articulated by 18 joints. Each segment consisted of a group of human parts as they are located in the human anatomy. To simplify the analysis, the segments were modeled as rigid bodies, and the mass properties of the segments were defined based on anthropometric databases and automatically set up by the software, assuming a normal-fit person. The 18 modeled joints, represented in FIG. 5, were upper neck 40, lower neck 41, thoracic 42 and lumbar 43 on spinal, scapular 44, shoulder 45, elbow 46, and wrist 47 on left and right arms, and hip 48, knee 49 and ankle 50 on left and right legs.

Although each joint contained three DOF and the model provided a total of 54 DOF only 29 of them were active in the simulation. The rest of the DOF were locked either because they did not physically exist (e.g. the frontal and transverse rotation of the knee), or were not necessary in the simulated activities for this study (e.g. some of the DOF in the neck do not move in normal walking). Some other DOF (e.g. the frontal and transverse rotation of the lumbar, hip and ankle) were also eliminated, allowing focus on the motion in the sagittal plane. Using this model and experimentally captured body-motion data in Cartesian space, the simulation software was capable of computing the joint trajectories in joint space. Using these joint trajectories data, the joint torques that were required to produce the assumed body motion were calculated.

Finally, the software applied the torques on the model joints and calculated the resulting ground reaction forces and other reaction forces from interactions with the environment. The environment was modeled as a set of contact forces between the human model and the ground or environment by using the contact dynamics capability of MSC ADAMS™. Body motion data was obtained from either a motion capture experiment published in the literature or some other online human motion database.

Example 6

The RGS model, as illustrated in FIG. 1, consisted of a 5-DOF platform and two 3-DOF leg exoskeletons. The platform, including the two parallelograms sections, a strut and a body harness assembly, was attached to the wall via a rotational joint, which allowed the entire apparatus to rotate about a vertical axis. The first and second parallelogram sections provided two additional DOFs, such that the body was able to move forward and backward. The strut was connected to the second parallelogram section through a rotational joint. The upper body was fixed to a rigid plate which was part of the body-harness assembly. This rigid plate was connected to the vertical strut through a hinge near the lumbar allowing the human torso to turn forward (patching) during walking.

The 5-DOF platform provided the body a large work space, such that the body moved within the work space as freely as possible. The leg exoskeletons, each of which included an upper parallelogram and a lower link, were capable of pivoting at the strut near the hip and also around the knee. The upper parallelogram and the lower link were fixed to the upper and lower legs respectively. The platform, along with the springs on it, was used to compensate the weight of the whole body, while the leg exoskeletons and the springs were used to balance the weight of the legs and feet of the human. The apparatus had a total of 13 independent rotational joints.

Example 7

Jumping Simulation

A simulation was conducted to study the feasibility of the proposed reduced-gravity simulator modeling the basic human activity of jumping. The cases of free-body jumping (referred to as "free jumping") was compared to the case of jumping with the reduced-gravity apparatus (referred to as "RGS jumping"). In the simulation, it was assumed that the total mass of the human and the suite was 200 kg.

A set of jumping kinematics data, available in CMU Graphic Lab Motion Capture Database, was used to generate a jumping motion. The motions with four different reduction ratios (i.e. Σ=0, 0.5, 0.62, and 5/6) were simulated. The vertical displacement of the human mass center in "RGS jumping" (jumping with the RGS device attached) and "free jumping" (jumping without the RGS device) with four different reduction ratios were plotted in FIG. 6 and FIG. 7, respectively. The peak height, peak time, and takeoff velocity (i.e., the velocity when leaving the ground) for both "free jumping" and "RGS jumping" situations in each of the four cases are listed and compared in Table 1.

TABLE 1

Free Jumping vs. RGS Jumping*

| Case | Peak Height (mm) | Peak Time (sec.) | Takeoff Velocity (m/sec.) |
|---|---|---|---|
| | Free Jumping | | |
| ρ = 0 (Earth) | 136.13 | 1.53 | 1.61 |
| ρ = 0.5 | 284.72 | 1.71 | 1.64 |
| ρ = 0.62 (Mars) | 341.26 | 1.79 | 1.59 |
| ρ = 5/6 (Moon) | 746.49 | 2.33 | 1.57 |
| | RGS Jumping | | |
| ρ = 0 (Earth) | 163.42 | 1.58 | 1.45 |
| ρ = 0.5 | 333.81 | 1.88 | 1.45 |
| ρ = 0.62 (Mars) | 378.29 | 1.79 | 1.45 |
| ρ = 5/6 (Moon) | 457.89 | 2.13 | 1.46 |

*All data were measured at body mass center

Figure 6:
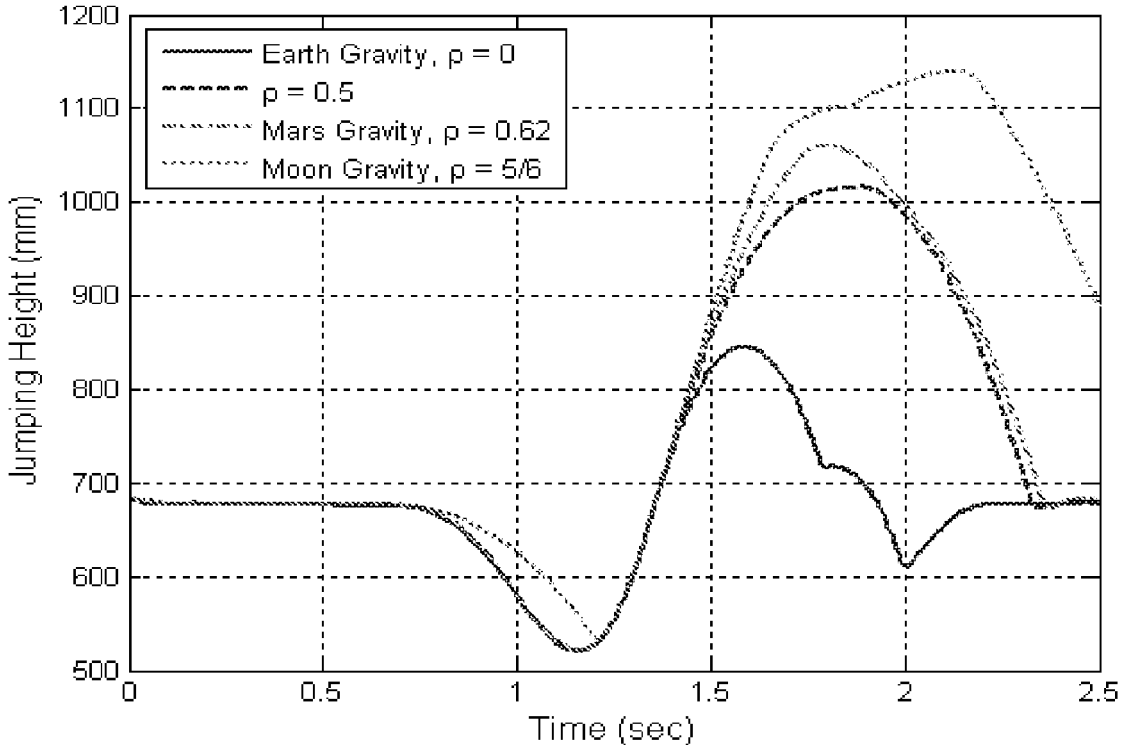
FIG. 6 is a graph illustrating the vertical displacements of the center of body mass of a human jumping with the RGS under different levels of gravity.
Figure 7:
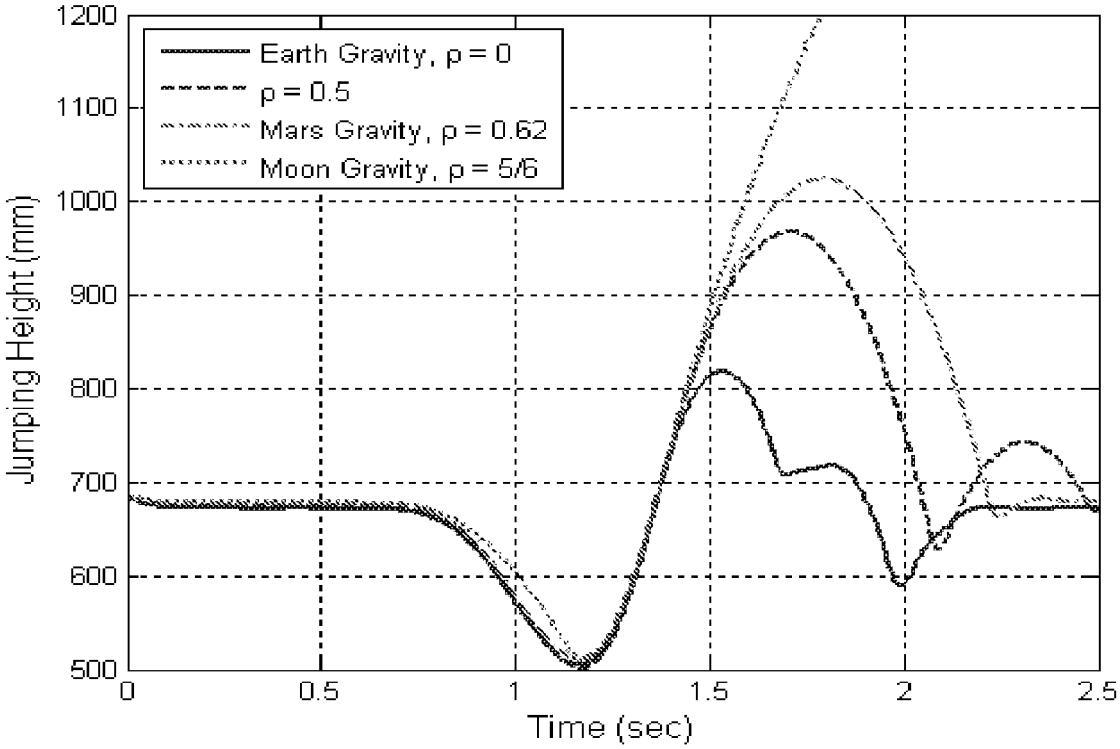
FIG. 7 is a graph illustrating the vertical displacements of the center of body mass of a human free jumping under different levels of gravitational force.

FIG. 6 illustrates that the more the body weight was reduced, the higher the person's jump and the longer the person remained above the ground. However, compared with the time history in the "free jumping" (as shown in FIG. 7), the time history of vertical displacement in "RGS jumping" was different, especially for a large reduction ratio (e.g. ρ=5/6). This was mainly because when the apparatus was attached to the human body, the motion of the human (e.g. jumping height in this case) was restricted by the workspace size of the RGS apparatus.

Table 1 illustrates that the peak height in "RGS jumping" (except when ρ=5/6) was higher than that in "free jumping", while the takeoff velocity was lower. The total kinetic energy of the human and the apparatus in "RGS jumping" was greater than that of the human alone in the "free jumping", such that the resulting peak height in "RGS jumping", which corresponded to the potential energy, was also higher than that in the "free jumping" situation. The human jumped up with an apparatus. The human body and also the apparatus gained kinetic energy as well as velocity, and thus, it resulted in a greater total kinetic energy, because the takeoff velocity of the human body in both situations was almost equivalent. The apparatus's mass influenced the results. The apparatus provided a better simulation of the real reduced gravity condition when lightweight materials were used to construct the RGS apparatus.

Example 8

Walking

A human model walking on a fixed flat floor was simulated using a set of ground walking data provided by LifeMOD™. The data was captured from a ten-year-old child walking on a flat floor. To imitate the relative motion between the human body and the treadmill, the first vertical bar of the RGS apparatus was specified to have a constant speed, rather than being fixed to the wall. This constant speed equaled the average walking speed, such that the relative motion between the human body and the floor was the same in average as if he/she walked on a running treadmill and thus, the resulting system response from the simulation was also valid.

In the simulation, the springs were chosen to balance out ⅚ of the Earth gravity force in order to simulate a moon environment. The resulting ground reaction force and joint torques were collected and compared with those of the same person walking in the moon's gravity field. Three materials (i.e. aluminum, titanium and steel) were chosen as the structural materials of the apparatus to learn more about the influence of the mass of the apparatus. The same walking gait was used in the dynamics simulations of all the three cases.

Example 9

Comparison of Ground Reaction Force

Figure 8A:
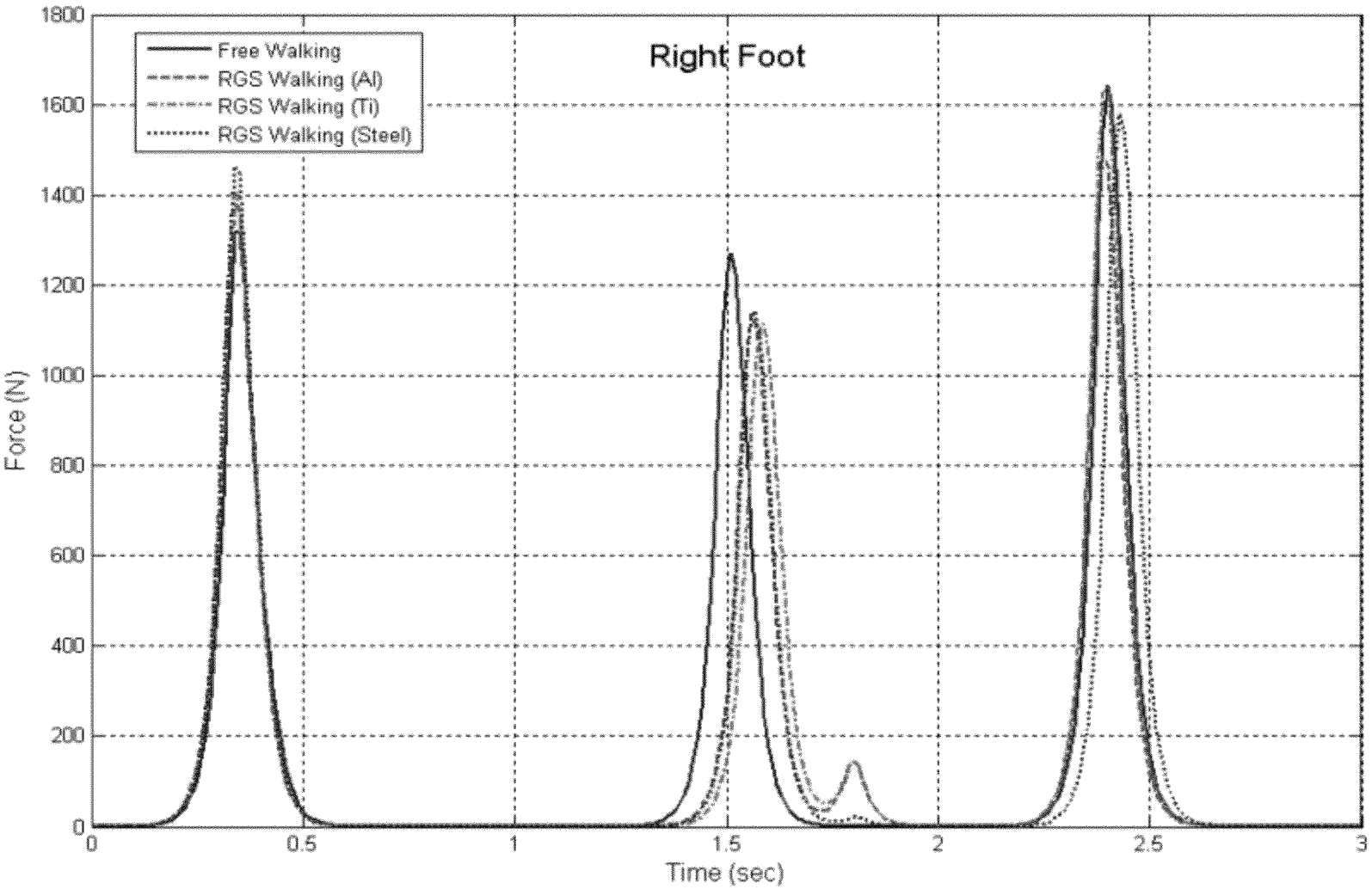
FIG. 8 is a graph illustrating ground reaction force on feet when a human walks with or without an RGS.
Figure 8B:
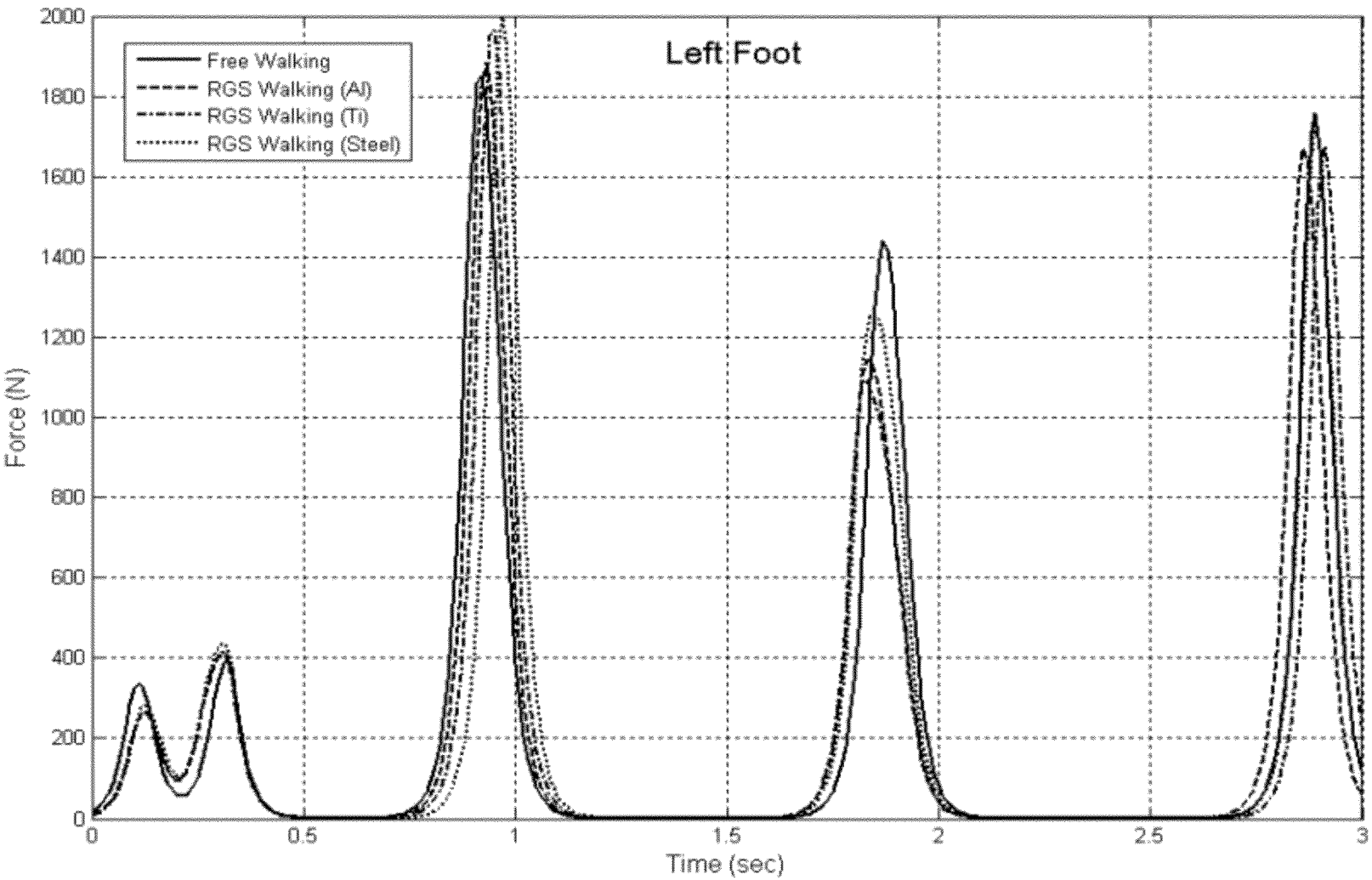

The magnitude of the ground reaction forces on both the left and the right feet, which represents the interaction between the human trainee and the environment, were plotted in FIG. 8. The time responses of the ground reaction forces in all four cases are almost identical. These curves illustrated not only a similar behavior but also close peak values. Thus, the resultant ground reaction forces which the human felt in the RGS walking were almost identical to that felt in the free-walking on the Moon. This illustrated that the RGS technology is able to simulate a real reduced-gravity environment, such as that on the moon, at a reasonable level of accuracy.

Simulation errors are list in Table 2. A simulation error refers to the difference between the ground reaction forces of the RGS walking and that of the free walking on the Moon. As shown in Table 2, the absolute peak error is around 350N, which is less than 18% of total body weight (i.e. 200 kg), and the magnitude of the phase error is less than 0.1 sec., which is almost imperceptible to a human. The force errors were primarily due to the inertia load of the RGS apparatus, which is non-linear, but not proportional to the mass of the apparatus.

Example 10

Comparison of Joint Torques

Figure 9A:
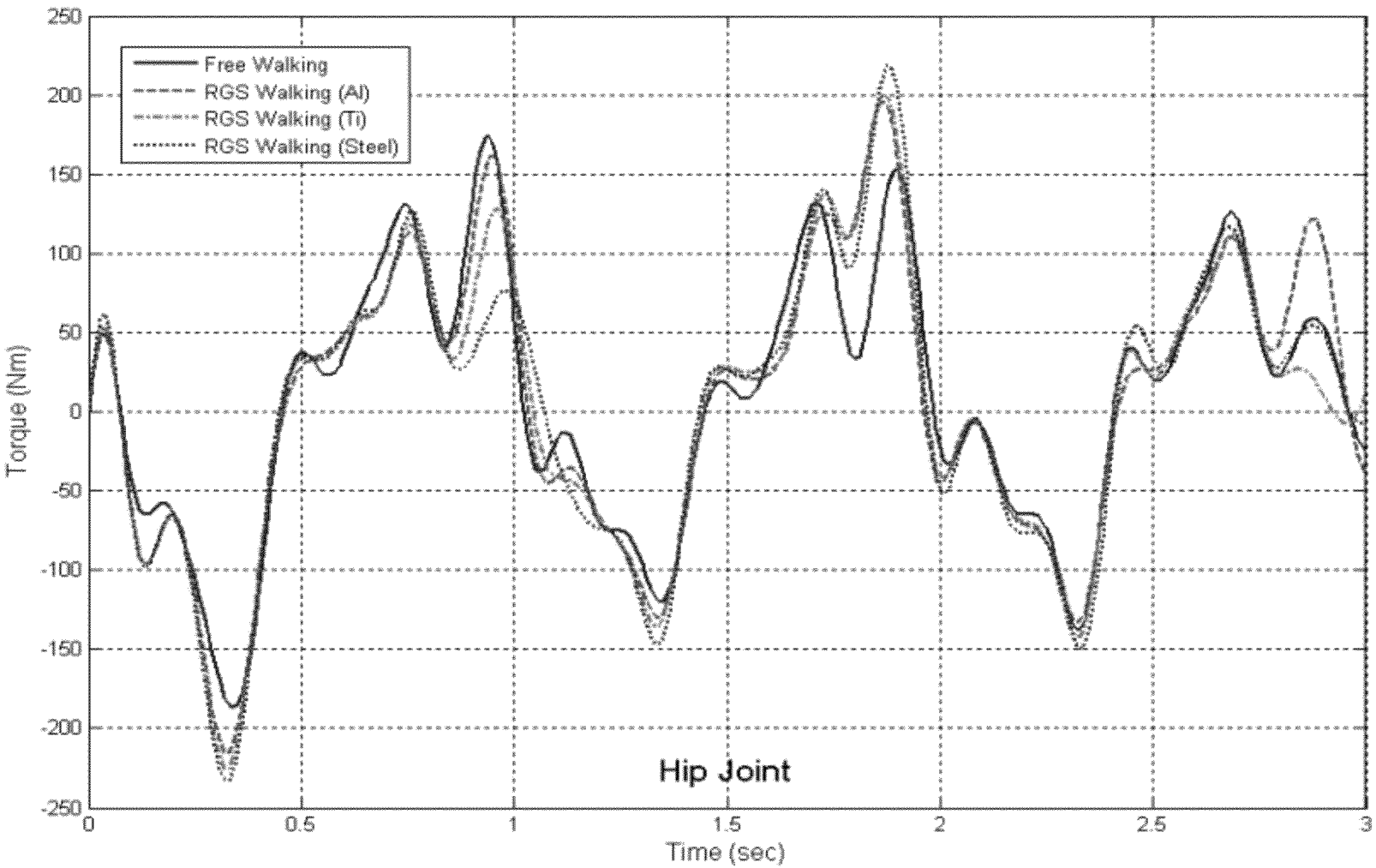
FIG. 9 is a graph illustrating joint torques in the sagittal plane when a human walks with an RGS.
Figure 9B:
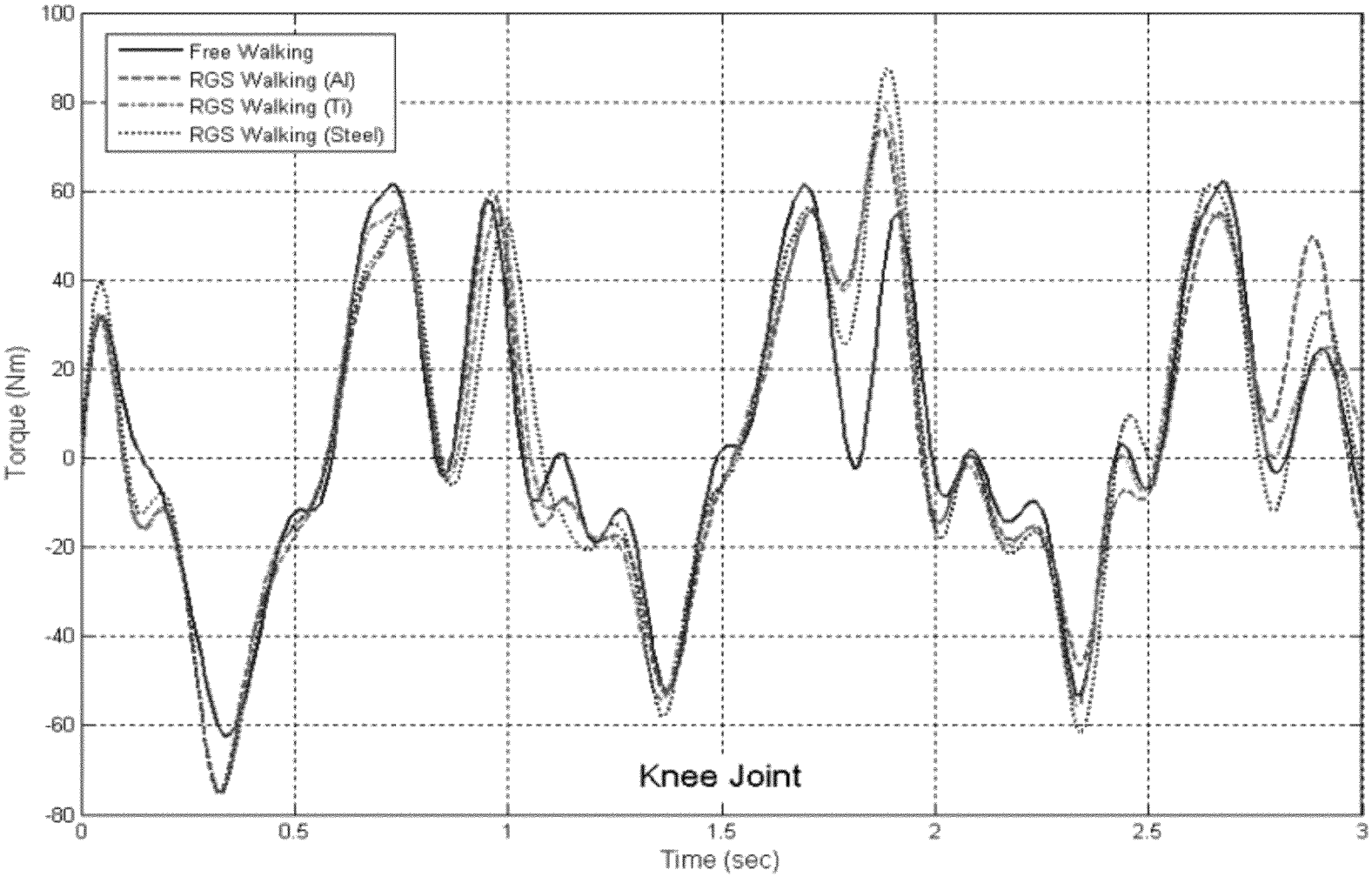
Figure 9C:
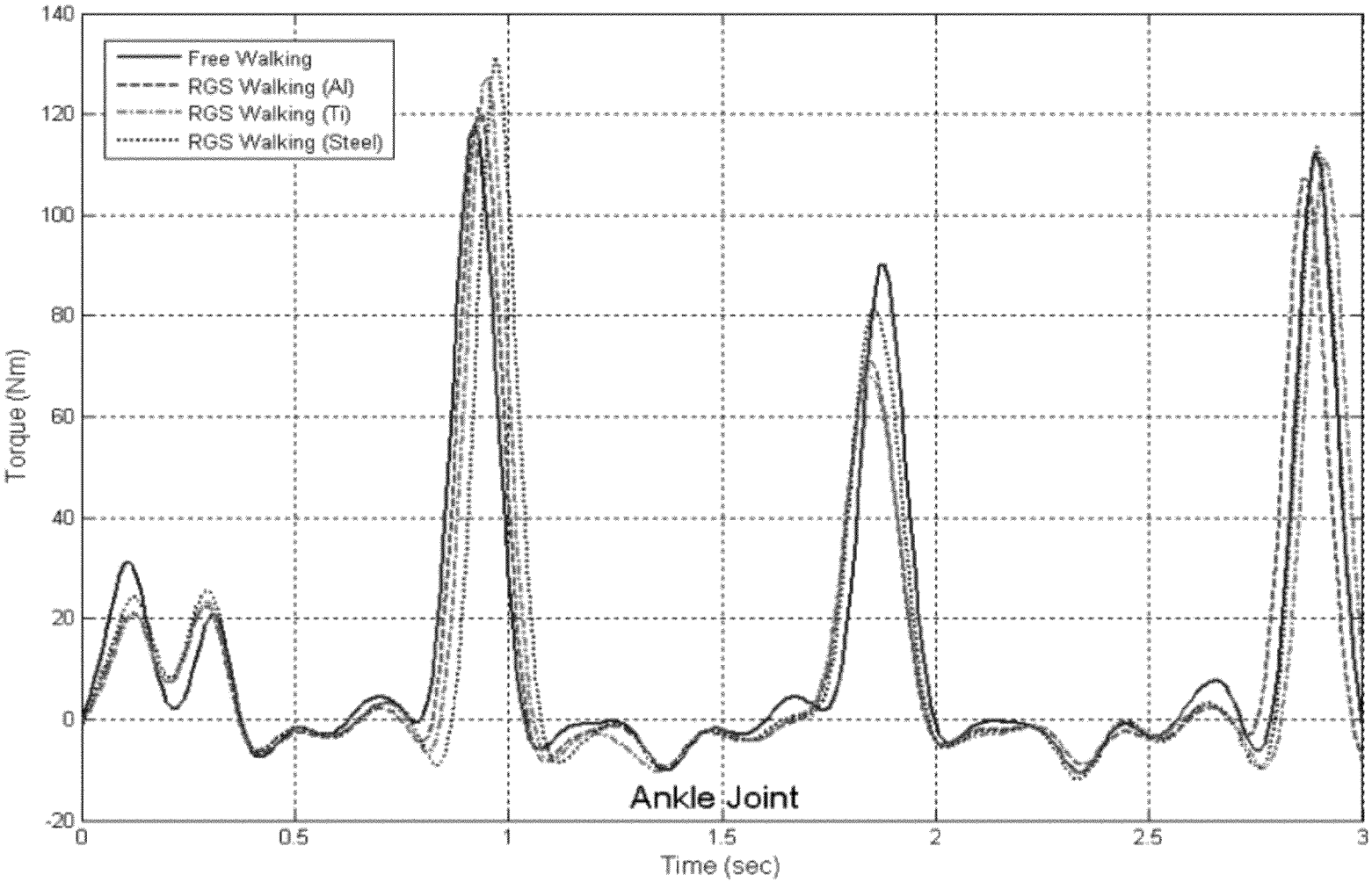

The joint torques in the hip, knee and ankle joints in the sagittal plane, for both free walking and RGS walking were plotted in FIG. 9 for comparison. Joint torques in RGS walking were almost identical to those in the free-walking condition. Joint torques represented the effort that the human made in order to follow the proscribed walking gait. A larger torque required more effort of the human. The mass of the apparatus also introduced additional inertia torques to the system, especially in the hip and knee joints. However, since the human body is an insensitive system (compared to instruments), it was possible to reduce the difference below the threshold by using a lightweight apparatus.

TABLE 2

| The Largest Peak Error and Phase error | | | | |
|---|---|---|---|---|
| Material | Left Foot | | Right Foot | |
| | Largest Absolute/Relative Peak Error (N/%) | | | |
| Al (14.4 kg)* | −296 | −20.5% | −155 | −9.4% |
| Ti (24 kg) | −345 | −24% | −2.2 | −0.1% |
| Steel (41.6 kg) | −182 | 12.6% | −61 | −3.7% |
| | Largest Phase Error (ms) | | | |
| Al (14.4 kg) | −40 | | 50 | |
| Ti (24 kg) | −40 | | 80 | |
| Steel (41.6 kg) | −20 | | 60 | |

*The number in the brackets represents the approximate weight of the RGS apparatus associating with the material.

A gravity-balanced multi-DOF passive apparatus was used to simulate walking and jumping in a reduced-gravity environment, thus providing an alternative simulation technology for training astronauts for planetary exploration missions. The reduced-gravity simulator, along with the human, was modeled as a multi-body dynamical system.

Two activities, namely, jumping and walking, were simulated and compared between the free-body condition (i.e. without the reduced-gravity simulator) and the constrained-body condition (i.e. with the reduced-gravity simulator). The simulation results showed that a human in the RGS-constrained case tended to produce a similar dynamic behavior to the one in the free body case. Also, the ground reaction forces and joint torques that a human is subject to in RGS walking was almost identical to that in the real reduced-gravity environment. The proposed RGS apparatus was capable of simulating human walking in a realistic reduced-gravity condition.

Additional inertia and friction loads due to the mass and joints of the RGS apparatus were applied to the human body when the human was exercising with the apparatus. These additional loads were reduced by using lightweight materials and proper design of the apparatus.

The preceding examples are repeatable with similar success by substituting the generically or specifically described initial conditions and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated herein by reference.

What is claimed is:

1. A reduced-gravity simulator assembly comprising:

a platform comprising at least five degrees of freedom, said platform comprising a strut and at least one spring, a first end of said spring attached to an upper portion of said strut, and a second end of said spring attached to a first end of a backplate;

a second end of said backplate attached directly to a lower portion of said strut and hingeably moveable with respect to said lower portion of said strut;

at least one leg exoskeleton comprising at least three degrees of freedom attached to said lower portion of said strut, said leg exoskeleton comprising a spring attachment point which is slideable with respect to a portion of said leg exoskeleton; and a treadmill.

2. The reduced-gravity simulator assembly of claim 1 wherein said five degrees of freedom platform comprises at least one parallelogram.

3. The reduced-gravity simulator assembly of claim 1 wherein said five degrees of freedom platform comprises at least one body harness.

4. The reduced-gravity simulator assembly of claim 1 wherein said three degrees of freedom leg exoskeleton supports and balances a weight of a human leg.

5. The reduced-gravity simulator assembly of claim 1 comprising two leg exoskeletons comprising at least three degrees of freedom.

6. The reduced-gravity simulator assembly of claim 1 wherein an upper portion of said leg exoskeleton attaches to a human thigh and a lower portion of said leg exoskeleton attaches to a human lower leg.

7. The reduced-gravity simulator assembly of claim 1 wherein said five degrees of freedom platform supports an entire human body weight.

8. The reduced-gravity simulator assembly of claim 1 wherein one side of said backplate is disposed adjacent to a human torso.

9. The reduced-gravity simulator of claim 1 further comprising a plurality of rotating couplings comprising hinges.

10. The reduced-gravity simulator of claim 5 further comprising eleven independent degrees of freedom.

11. The reduced-gravity simulator of claim 1 further comprising a plurality of connectors comprising spring attachment points.

12. A method of initializing a reduced-gravity simulator comprising:

attaching the reduced-gravity simulator assembly to a user;

attaching at least one leg exoskeleton to a lower portion of a strut and a leg of the user, the exoskeleton comprising at least three degrees of freedom;

attaching at least one spring to a spring attachment point on the exoskeleton;

sliding the spring attachment point relative to a portion of the exoskeleton until the pressure underneath the user is at least partially eliminated;

maintaining a constant potential energy of the assembly by adjusting the spring attachment point location to statically balance the gravity force at a working configuration; and adjusting the stiffness values of the spring such that the user feels as if they are in a reduced gravity environment.

13. The method of claim 12 further comprising using a treadmill to allow continuous forward walking.

14. The method of claim 12 wherein attaching to the user comprises:

attaching the user's torso to a backplate;

allowing the torso to freely move in five degrees of freedom;

supporting at least one of the user's legs by the three degrees of freedom exoskeleton allowing free movement of the leg; and providing redundant degrees of freedom about the Z axis to allow ergonomic comfort while the user is walking.

15. The method of claim 12 wherein the step of sliding the spring attachment point relative to a portion of the exoskeleton comprises:

sliding the spring attachment points and measuring pressure until the measured pressure underneath the user's foot is completely gone but the foot still touches the treadmill;

changing the body and/or leg pose; and repeatedly sliding the spring attachment point until required balancing is achieved.

16. The method of claim 15 wherein measuring pressure is measured manually.

17. The method of claim 15 wherein measuring pressure is measured automatically.

18. The method of claim 17 wherein measuring pressure automatically comprises installing an actuated spring adjustment device for the spring.

19. The method of claim 12 further comprising the steps of:

scaling the spring attachment point based on the percentage of gravity which is to be reduced; and retaining a percentage of the pressure under a foot of the user because partial gravity is still present.

* * * * *